United States Patent [19]

Hinton

[11] Patent Number: 5,066,018

[45] Date of Patent: Nov. 19, 1991

[54] DEFORMABLE SPHERE WITH A SUCTION CUP EXTERIOR

[76] Inventor: Dean S. Hinton, 10400 Masters Terrace, Potomac, Md. 20854

[21] Appl. No.: 597,038

[22] Filed: Oct. 16, 1990

[51] Int. Cl.[5] ..... A63B 43/00; A63B 65/00

[52] U.S. Cl. ..... 273/344; 273/58 F; 273/58 K; 273/415

[58] Field of Search ..... 273/344, 415, 58 E, 273/58 F, 58 K

[56] References Cited

U.S. PATENT DOCUMENTS

| | | | |
|---|---|---|---|
| 922,717 | 5/1909 | Parker | 273/415 X |
| 1,722,784 | 7/1929 | Blair | 273/58 F X |
| 2,187,524 | 1/1940 | Price | 273/344 |
| 3,008,719 | 11/1961 | Misko | 273/58 R X |
| 3,601,923 | 8/1971 | Rosenberg | 273/320 X |
| 3,941,383 | 3/1976 | Clarke | 273/424 X |
| 4,212,460 | 7/1980 | Kraft | 273/58 B |
| 4,448,418 | 5/1984 | McNeill | 273/58 F X |
| 4,872,676 | 10/1989 | Townsend | 273/58 F X |

FOREIGN PATENT DOCUMENTS

| | | | |
|---|---|---|---|
| 2539634 | 7/1984 | France | 273/344 |

*Primary Examiner*—William H. Grieb

*Attorney, Agent, or Firm*—David H. Semmes

[57] ABSTRACT

Recreational devices, particularly a deformable ball or sphere having an interior filled with particulate aggregate and an exterior supporting a plurality of radially extending suction cups, such that the suction cups engage a supporting surface upon which the ball may be thrown. The deformable character of the ball enables the sphere exterior to assume a planar surface as the suction cups engage the supporting surface.

8 Claims, 3 Drawing Sheets

DEFORMABLE SPHERE WITH A SUCTION CUP EXTERIOR

BACKGROUND OF THE INVENTION

1. Field of the Invention

Recreational toys, particularly a deformable sphere or ball with a suction cup exterior. The interior of the ball is partially filled with a particulate aggregate, such that a substantially planar surface is assumed by the exterior of the sphere as the suction cups, engage a supporting surface upon which the sphere may be thrown.

2. Description of the Prior Art

MISKO—U.S. Pat. No. 3,008,719
ROSENBERG—U.S. Pat. No. 3,601,923
CLARKE—U.S. Pat. No. 3,941,383
KRAFT—U.S. Pat. No. 4,212,460
McNEIL—U.S. Pat. No. 4,448,418

The prior art depicts especially constructed recreational balls which may adhere to a specific target such as a "VELCRO" or magnetic surface. However, the prior art does not teach a deformable sphere or ball having a suction cup exterior and interior partially filled with loose aggregate.

SUMMARY OF THE INVENTION

According to the present invention, a deformable sphere is provided with a suction cup exterior in the form of plurality flexible suction cups extending radially outwardly thereof. A particulate aggregate is loosely supported within the sphere such that a substantially planar surface is assumed by the sphere exterior as the suction cups engage a supporting surface upon which the sphere is thrown.

DESCRIPTION OF THE PREFERRED EMBODIMENTS

Figure 1:
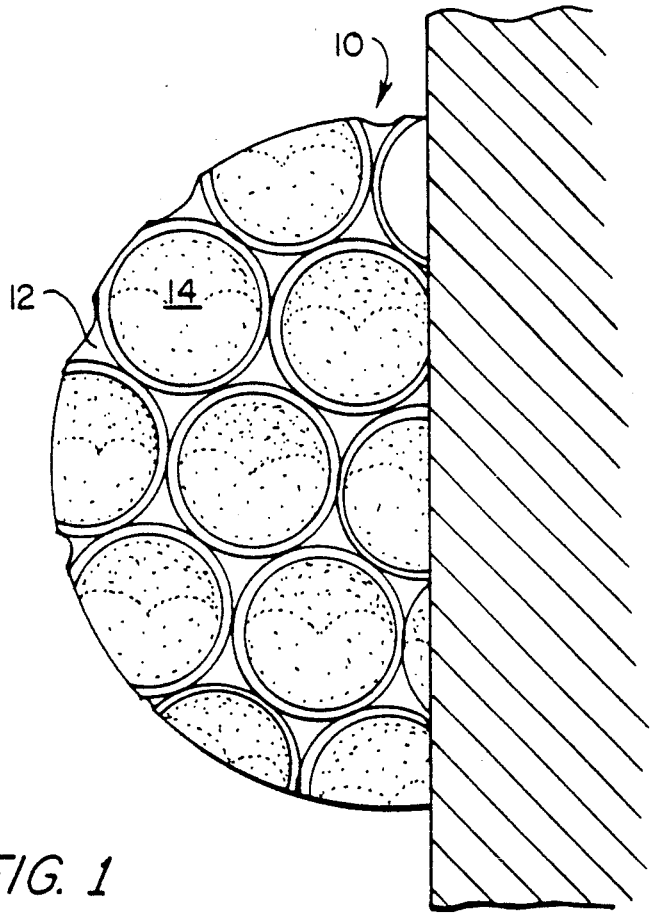
FIG. 1 is a partially fragmentary side elevation of the deformable sphere assuming a planar aspect, as the suction cups engage a supporting surface.
Figure 2:
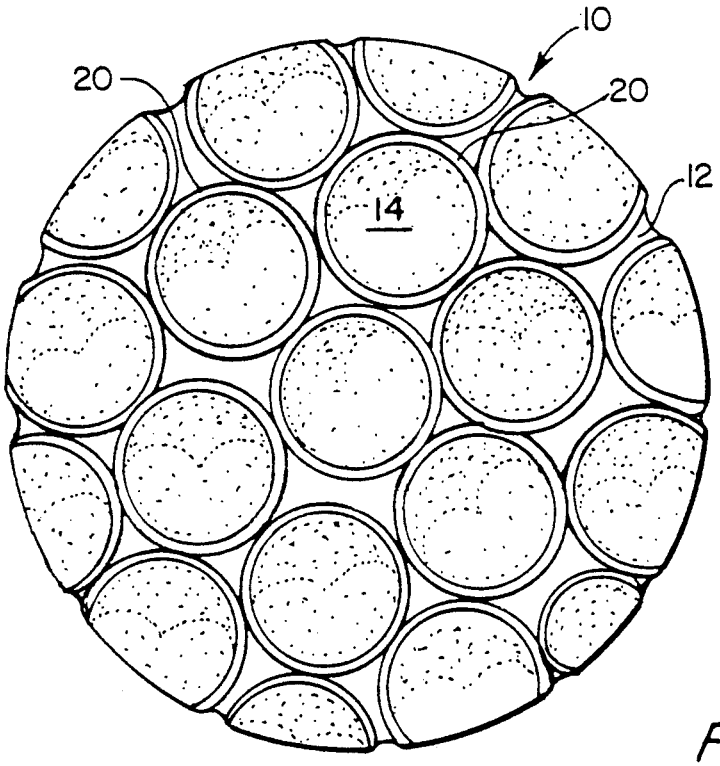
FIG. 2 is a front elevation of the sphere showing the adjacently positioned suction cups.
Figure 3:
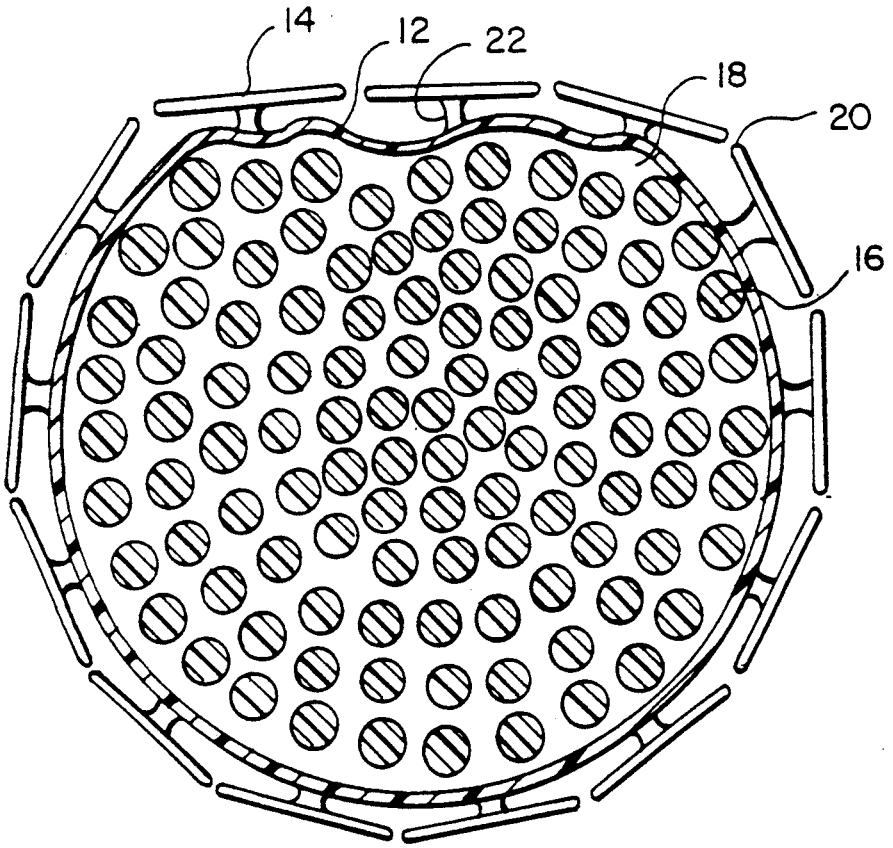
FIG. 3 is a transverse section taken through the sphere showing the particulate aggregate loosely supported within the sphere and the suction cups extending radially outwardly of the sphere exterior.
Figure 4:
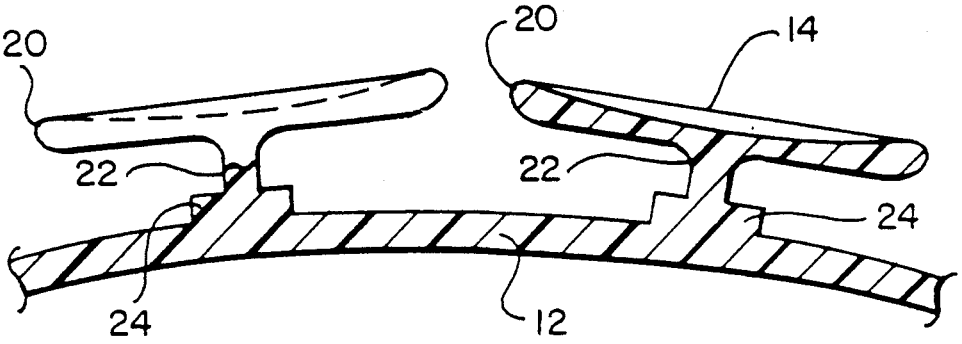
FIG. 4 is an enlarged elevation, partially in section, showing the construction of the individual suction cups with respect to the sphere.

As illustrated in FIGS. 1 through 4, a ball or sphere 10 approximately 4 inches in diameter may consist of a flexible shell 12 of soft rubber or the like ⅛ inch thick. Flexible shell 12 is covered with approximately twenty-five radially extending vacuum cups 14, each cup being approximately 1 inch in diameter and defined by circumferential edge 20. Vacuum cups 14 may be made of soft rubber 1/16 inch thick and secured by adhesive or the like, or molded integrally with shell 12 to extend radially approximately ¼ inch. The circumferential edges of vacuum cups 14 are positioned as closely as is possible upon the sphere exterior. The sphere interior supports an aggregate of particulate matter, such as beans (approximately ¾ volume) and air (approximately ¼ volume). This construction aids the suction function of the sphere by placing the maximum amount of vacuum cups 14 onto a surface that the sphere is thrown against. As will be apparent, ball 10 remains as a sphere in the palm of the hand, ready to be thrown or distorted in play. After being thrown against a surface sphere 10 becomes a hemi-sphere with its flat plane contacting the supporting surface (as illustrated in FIG. 1). Approximately 10 vacuum cups 14 will create a strong enough vacuum force to hold the ball on the surface.

Figure 5:
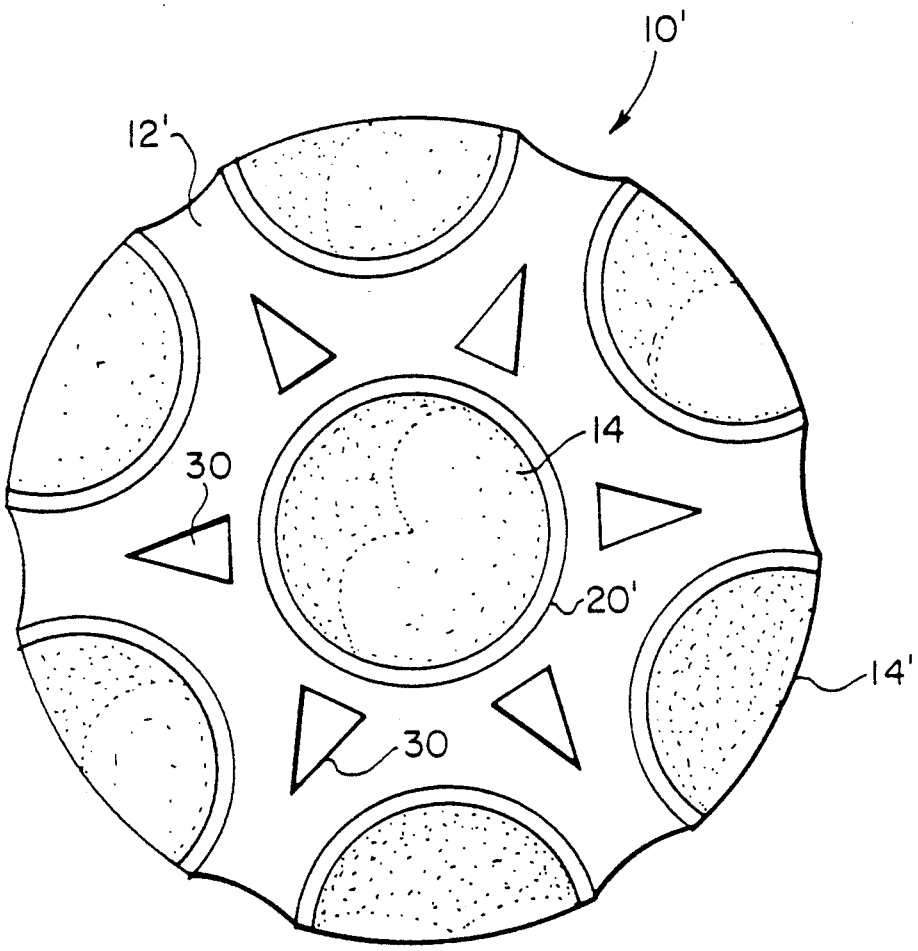
FIG. 5 is a front elevation of a modified sphere, having triangular air holes or vents 30 as an aid to deformability.

In FIG. 5 modified sphere 10' is shown as comprised of flexible shell 12' with radially extending vacuum cups 14' and triangular air holes or vents 30 as an aid to deformability.

It is respectfully submitted this invention relates thusly to a new type of ball or sphere which enhances the recreation of users by performing many different functions at once. The ball is lightweight and deformable which makes it safe for children and indoor play. The ball may be multicolored, which makes it pleasing to the eye. Since the ball is deformable, it will mold to the object it is touching. The suction cups performs its function of suction better than existing devices. As will be apparent, the ball does not loose its effectiveness after many uses, as is the case of the currently marketed "Wacky Wall Walker" which must be cleaned of the lint and dust which collects onto the sticky surface after practically every use, and which eventually looses its effectiveness by a loss of stickiness. Applicant's ball performs the same function with beans as the "Koosh Ball" does with rubber strands, as TOWNSEND U.S. Pat. No. 4,872,676 does with water, and as McNEIL U.S. Pat. No. 4,448,418 does with steel weights in that applicant's ball rolls to a halt in a very short distance in the event that it is mis-thrown or mis-caught, which aids in the amount of recreation during play. Applicant's ball does not need to be thrown at a specific magnetic target in order to stick to a surface as in McNEIL U.S. Pat. No. 4,448,418 or at a "VELCRO" target in the case of CLARKE U.S. Pat. No. 3,941,383. Applicant's ball may be thrown. at any surface since the radially extending vacuum cups are always present so as to stick to the supporting surface for enjoyment. Applicant's ball has an interior aggregate consistency which makes it easy to catch and easy to throw. Applicant's ball will not collect dirt, since a sticky outer substance is not the way in which it performs its function. If the ball becomes dirty the ball is easily cleaned under a faucet or with a wet rag. This suction ball may be rendered attractive by variously coloring the suction cups.

Manifestly, variations in the construction of the suction cup, deformable sphere and aggregate interior may be employed without departing from the spirit of invention.

I claim:

1. A deformable sphere with a suction cup exterior comprising:

a) a deformable envelope, configured as a sphere;

b) a plurality of flexible suction cups supported upon the exterior of said sphere such that said suction cups extend radially outwardly thereof, with the edges of said suction cups positioned as closely as possible upon the sphere exterior, and c) particulate aggregate loosely supported within said sphere, such that a substantially planar surface is assumed by the exterior of said sphere as said suction cups engage a supporting surface.

2. A deformable sphere with suction cup exterior as in claim 1, said particulate aggregate substantially filling the interior of said sphere.

3. A deformable sphere with suction cup interior as in claim 2, the interior of said sphere being maintained at low pressure, so as to enhance deformability, as said suction cups contact a supporting surface.

4. A deformable sphere with suction cup exterior as in claim 3, said deformable envelope being approximately $\frac{1}{8}$ inch thickness and said suction cups having an approximate 1/16 inch thickness.

5. A deformable sphere with suction cup exterior as in claim 4, the vertical profile of each said suction cup extending approximately $\frac{1}{4}$ inch radially from the exterior of said sphere.

6. A deformable sphere with suction cup exterior as in claim 5, said sphere being approximately four inches in diameter and wherein said suction cups cover substantially the entire peripheral surface of said sphere.

7. A deformable sphere with suction cup exterior as in claim 2 wherein said particulate aggregate is in the form of beans.

8. A deformable sphere with suction cup exterior as in claim 1, wherein said sphere includes at least one vent defined in its surface.

* * * * *